US006935078B1

(12) United States Patent
Benkel

(10) Patent No.: US 6,935,078 B1
(45) Date of Patent: Aug. 30, 2005

(54) ANCHOR FASTENER CLIP

(76) Inventor: Friedrich K Benkel, 3001 Highway 417, Woodruff, SC (US) 29388

( * ) Notice: Subject to any disclaimer, the term of this patent is extended or adjusted under 35 U.S.C. 154(b) by 26 days.

(21) Appl. No.: 10/747,794

(22) Filed: Dec. 29, 2003

(51) Int. Cl.[7] ..... E06B 3/964

(52) U.S. Cl. ..... 52/204.69; 52/204.7; 52/204.595; 52/656.5; 52/656.6; 52/656.8; 52/656.9; 52/704; 52/455; 52/456

(58) Field of Search ..... 52/204.5, 204.61, 52/504.593, 656.8, 656.9, 455–456, 786.13, 52/309.1, 665, 309.4, 309.8, 311.1, 314, 316, 52/713, 204.7, 656.5, 656.6, 704, 708, 204.591, 52/204.595, 204.6, 204.69, 786.11, 800.14; 403/326, 329, 292, 294, 317, 282, 240

(56) References Cited

U.S. PATENT DOCUMENTS

| | | | | |
|---|---|---|---|---|
| 2,214,222 A | * | 9/1940 | Chaffee | 52/172 |
| 2,604,061 A | * | 7/1952 | Estey | 52/204.593 |
| 3,447,823 A | | 6/1969 | Gregoire | |
| 3,784,144 A | | 1/1974 | Ollinger et al. | |
| 3,982,306 A | | 9/1976 | Curry | |
| 4,376,359 A | | 3/1983 | Redman | |
| 4,531,335 A | | 7/1985 | Mangan | |
| 4,707,963 A | * | 11/1987 | Governale | 52/745.15 |
| 4,723,749 A | | 2/1988 | Carraro et al. | |
| 4,886,102 A | | 12/1989 | Debs | |

(Continued)

FOREIGN PATENT DOCUMENTS

| | | |
|---|---|---|
| CA | 2.327.004 | 6/2001 |
| GB | 2.357.117 | 6/2001 |

*Primary Examiner*—Jeanette E. Chapman
(74) *Attorney, Agent, or Firm*—Michael I. Kroll

(57) ABSTRACT

The present invention 10 discloses an anchor fastener for mating parts to a channel 30 for, e.g., the attachment of muntin in a window 14 design. The end clip 15 of the preferred embodiment is comprised of molded polymeric material having means for aligning the clip with a channel and means for locking the clip to the channel. The clip is comprised of a base 16 having an upwardly extending post 18 that forms means for mounting other parts to the fastener. The post 18 can be of any shape, size or length depending on the part to be mated onto the post. Three spaced apart rails 24, 26 are formed under the base 16 to transversely engage the channel 30 with the center rail 24 also having a transverse slot 36 for matingly locking with the channel. The channel 30 has spaced apart notches 32 with tabs 34 positioned therebetween on opposing sides of the channel. The outside rails 24 of the fastener matingly engage the notches 32 with the center rail 26 having the transverse slot 36 for engaging and encompassing the channel tabs 34 thereby locking the fastener to the channel. The present invention 10 provides for an alternative design wherein a channel 30 has a notch forming an alignment for the end clip fastener with the center rail 26 of the fastener mating to the notch wherein the outside rails 26 of the fastener have transverse slots 36 for engaging the opposing flanges 38 of the channel 30.

9 Claims, 10 Drawing Sheets

U.S. PATENT DOCUMENTS 5,099,626 A * 3/1992 Seeger ..... 52/314
5,644,878 A 7/1997 Wehrmann
5,678,376 A * 10/1997 Poma ..... 52/656.8
5,720,460 A 2/1998 Watson
5,899,033 A * 5/1999 Merchlewitz ..... 52/204.61
5,918,656 A 7/1999 Daniels et al.
6,250,026 B1 * 6/2001 Thompson, Jr. ..... 52/172
6,289,641 B1 * 9/2001 McCandless ..... 52/172
6,301,843 B1 * 10/2001 Silverman ..... 52/204.5
6,425,221 B1 * 7/2002 Reichert ..... 52/456

* cited by examiner

ANCHOR FASTENER CLIP

BACKGROUND OF THE INVENTION

1. Field of the Invention

The present invention relates generally to fasteners and, more specifically, to an anchor fastener for mating parts to a channel. One application of the end clip is the attachment of muntin in a window design. The end clip of the preferred embodiment is comprised of molded polymeric material having means for aligning the clip with a channel and means for locking the clip to the channel. The clip is comprised of a base having an upwardly extending post that forms means for mounting other parts to the fastener. The post can be of any shape, size or length depending on the part to be mated onto the post. As herein described, the fastener for all intent and purposes forms an anchor whereby the aforementioned parts can be mounted to a channel.

On the opposing side three spaced apart rails are formed to transversely engage the channel with the center rail also having a transverse slot for matingly locking with the channel.

The channel has spaced apart notches with tabs positioned therebetween on opposing sides of the channel. The outside rails of the fastener matingly engage the notches with the center rail having the transverse slot for engaging and encompassing the channel tabs thereby locking the fastener to the channel. The body of the fastener residing within the channel can conform substantially to the cavity of the channel providing a greater degree of protection from torsional forces.

To mate the fastener to the channel the outside rails extend across the channel mating with and engaging notches within the channel flange. The center rail has a slot extending across the distal ends of the rail for matingly engaging and encompassing tabs formed by the channel notches. The channel tabs and fastener slots increase the structural integrity of the mating members.

The present invention provides for an additional element wherein a channel has a notch forming an alignment for the end clip fastener with the center rail of the fastener mating to the notch. The outside rails of the fastener have transverse slots for engaging the opposing flanges of the channel. The channel flange and fastener slots increase the structural integrity of the mating members.

2. Description of the Prior Art

There are other fastener devices designed for anchoring. Typical of these is U.S. Pat. No. 3,447,823 issued to Gregoire on Oct. 4, 1967.

Another patent was issued to Ollinger, et al. on Jan. 8, 1974 as U.S. Pat. No. 3,784,144. Yet another U.S. Pat. No. 3,982,306 was issued to Curry on Sep. 28, 1976 and still yet another was issued on Mar. 15, 1983 to Redman as U.S. Pat. No. 4,376,359.

Another patent was issued to Mangan on Jul. 30, 1985 as U.S. Pat. No. 4,531,335. Yet another U.S. Pat. No. 4,723,749 was issued to Carraro, et al. on Feb. 9, 1988. Another was issued to Debs on Dec. 12, 1989 as U.S. Pat. No. 4,886,102 and still yet another was issued on U.S. Pat. No. 5,644,878 to Wehrmann as U.S. Pat. No. 5,644,878.

Another patent was issued to Watson on Feb. 24, 1998 as U.S. Pat. No. 5,720,460. Yet another U.S. Pat. No. 5,918,656 was issued to Daniels et al. on Jul. 6, 1999. Another was issued to Binotti, et al. on Jun. 21, 2001 as Canadian Patent No. 2,327,004 and still yet another was issued on Jun. 13, 2001 to Dudney as G.B. Patent No. 2 357 11.

U.S. Pat. No. 3,447,823

Inventor: Resta S. Gregoire

Issued: Jun. 3, 1969

A one-piece anchor clip comprising: a body portion of sheet material having means formed therein for substantially rigid attachment to a supporting member, and a head portion including a planar base section and having a pair of planar ears joined to said base section with inturned, opposed ends thereon being spaced apart for mounting over the opposite edges of a double-edged base structure supported by said member, said ears being spread apart by being bent outwardly from their bases in opposite directions out of the plane of said base section to open the spacing between their unturned ends so as to facilitate their mounting over the edge portions of said structure by receiving said edges through said spacing between their ends before turning said clip to bring them freely over said edge portions.

U.S. Pat. No. 3,784,144

Inventor: James C. Ollinger, et al.

Issued: Jan. 8, 1974

A U-shaped clip is fastened directly to the ceiling joists. Into the clip member is inserted a simple conventional runner member to which is fastened the ceiling tile. A spring finger structure is utilized to hold the runner member relative to the clip member.

U.S. Pat. No. 3,982,306

Inventor: Walter J. Curry

Issued: Sep. 28, 1876

An extruded plastic channel receives the plastic film and a plastic locking strip is then engaged within the channel and under opposed overhanging beads on each side of the channel to clamp the film in position. One of the beads on the channel extends downwardly towards the base of the channel and an expansion bead or member extends upwardly from the base of the channel outboard of the outwardly extending bead which can flex sideways under pressure to compensate for different thicknesses of film. One embodiment includes a membrane connection between the downwardly extending bead and the expansion bead so that when the locking strip is snap engaged into the channel, the sideways displacement of the downwardly extending bead also moves the expansion bead outwardly to facilitate the engagement of the locking strip within the channel.

U.S. Pat. No. 4,376,359

Inventor: Ronald E. Redman

Issued: Mar. 15, 1983

A fastener for glazed doors of the type including a glazing panel and a frame having a channel-shaped surface extending along an edge of the panel and having a web normal to a panel face and a pair of opposite flanges. The fastener includes a thin sheet metal base adapted to be mounted on the web of the frame member and having wedge arms engageable against the opposite flanges of the frame member when the body of the fastener is rotated about an axis normal to the web with a tool or other implement to securely retain the fastener in place. The fastener includes one or more fingers having a free outer end extending outwardly toward an adjacent flange of the frame member and spaced from the web in order to form a slot for receiving an inside edge of glazing strip which is positioned between the finger and the adjacent flange. The fasteners can be rapidly installed on the frame members with only a screw driver and do not require any hole drilling or punching operations or the use of any separate screws, rivets, or clips.

U.S. Pat. No. 4,531,335

Inventor: Denis Mangan

Issued: Jul. 30, 1985

The method of applying a glass flushly to a flanged window aperture comprises the steps of attaching resilient fixing clips, which have means for attachment to the glass and catch means for locating positively on the window aperture flange, at spaced intervals around the periphery of the glass, applying a bead or beads of sealant at least on the outwardly facing surface of the window aperture flange; locating the glass with the fixing clips attached in the window aperture and pressing down on to the sealant bead(s), and further pressing the glass home towards the flange until the fixing clips act under the applied pressure and against their resilience so as to deform intermediate sections B thereof sufficiently to permit their catch means to pass through the flange aperture, release of said further pressure permitting the fixing clips, due to their resilience, to restore into their original form and cause the catch means to locate behind said flange and thus positively hold the glass in position within the window aperture and pressed against the sealant. The invention includes within its scope fixing clips suitable for use with the method, and a flush glass system fitted by use of the method and the fixing clips.

U.S. Pat. No. 4,723,749

Inventor: Eugene Carraro et al.

Issued: Feb. 9, 1988

This invention relates to a construction fastener and more specifically to a clamp or clip for securing a horizontally extending channel to another horizontally or vertically extending construction element of miscellaneous configuration. The fastener is formed from a strip of resilient metal or spring steel and at least one end includes a notched portion for engaging a horizontally extending channel. The notched portion is oriented with respect to the horizontal channel such that the longitudinal planar surface of the notched portion is normal to the horizontal axis of the channel. The notched portion includes a cam-like spring tab adapted to spring out of the way and to snap back and lock behind the channel when the channel is inserted into the notched portion. The opposite end of the fastener, which may be engaged or disengaged with or without the channel in the notched portion, may comprise a wire or rod receiving notched portion or it may comprise one of a variety of forms capable of engaging vertically or horizontally extending construction elements of miscellaneous configuration.

U.S. Pat. No. 4,886,102

Inventor: Victor Debs

Issued: Dec. 12, 1989

A Venetian blind has a plurality of slats, a head, brackets for mounting the head on a support, ladder assemblies for suspending the slats from the head, cables provided in the head for lifting and lowering the slats, and cables provided in the head for tilting the slats from essentially horizontal positions to tilted positions and vice-versa. The head has a top and no bottom intermediate the top and the slats.

U.S. Pat. No. 5,644,878

Inventor: Gary Wehrmann

Issued: Jul. 8, 1997

In order to simplify the quick and easy re-construction of a clean room which is constructed of prefabricated panels that are adapted to be connected to stud members, and to avoid the use of screws and bonds, a trim system which features a plurality of different trims is provided. By selecting a suitable trim from the plurality, and fitting it onto an edge of a panel by way of a channel or receiving portion provided thereon, it is possible to use existing studs and double finger T-clips to combine a variety of different panels together while taking advantage of a propriety type connection flanges which may be formed on some of the panels which are available.

U.S. Pat. No. 5,720,460

Inventor: Robert B. Watson

Issued: Feb. 24, 1998

A fixing clip for mounting a furring channel onto a support structure. The clip has a base portion through which the clip is attached to the support structure. A connection portion extends from the base portion so as to outstand from the support structure when the clip is attached thereto. A furring channel is connectable to the connection portion at a selected one of a plurality of connecting positions spaced from the base portion. That in turn locates the furring channel at a predetermined distance from the support structure.

U.S. Pat. No. 5,918,656

Inventor: James Daniels, et al.

Issued: Jul. 6, 1999

A method for sizing a horizontal mini-blind using a retaining clip. The retaining clip frictionally engages a lift cord threaded through a series of slots formed within a series of horizontal slats. The mini-blinds are sized attaching the retaining clip to the lift cord, cutting the lift cords underneath the retaining clip below the rung cords, then sliding the retaining clip into a channel formed in a bottom rail. The bottom rail includes a pair of oppositely facing notches which receive the ladder cords to prevent further movement of the clip in the channel. The ladder cords and the lift cord are not knotted and captured using a plug in the bottom rail, which results in a flush relationship between the bottom rail and a window opening.

Canadian Patent Number 2,327,004

Inventor: Marla A. Binotti et al.

Issued: Jun. 21, 2001

A method for sizing a horizontal mini-blind using a retaining clip. The retaining clip frictionally engages a lift cord threaded through a series of slots formed within a series of horizontal slats. The mini-blinds are sized attaching the retaining clip to the lift cord, cutting the lift cords underneath the retaining clip below the rung cords, then sliding the retaining clip into a channel formed in a bottom rail. The bottom rail includes a pair of oppositely facing notches which receive the ladder cords to prevent further movement of the clip in the channel. The ladder cords and the lift cord are not knotted and captured using a plug in the bottom rail, which results in a flush relationship between the bottom rail and a window opening.

Great Britain Patent Number 2,327,004

Inventor: Marla A. Binotti et al.

Issued: Jun. 21, 2001

A clip for securing a longitudinally extending product in position on a channel member, which clip comprises a first portion for receiving the product and a second portion for locking the clip to the channel member, the channel member having a longitudinally extending channel and a pair of lips which define a mouth to the channel, the second portion having a pair of flexible locking members for co-operating with the lips in order to lock the clip to the channel member, the first portion being rotatable with respect to the second portion, and the first portion having a cam which is caused by the rotation of the first portion with respect to the second portion to lock the locking members in a locked position in which they co-operate with the lips in order to lock the clip to the channel member.

While these fasteners may be suitable for the purposes for which they were designed, they would not be as suitable for the purposes of the present invention, as hereinafter described.

SUMMARY OF THE PRESENT INVENTION

The present invention discloses an anchor fastener for mating parts to a channel for, e.g., the attachment of muntin in a window design. The end clip of the preferred embodiment is comprised of molded polymeric material having means for aligning the clip with a channel and means for locking the clip to the channel. The clip is comprised of a base having an upwardly extending post that forms means for mounting other parts to the fastener. The post can be of any shape, size or length depending on the part to be mated onto the post. Three spaced apart rails are formed under the base to transversely engage the channel with the center rail also having a transverse slot for matingly locking with the channel. The channel has spaced apart notches with tabs positioned therebetween on opposing sides of the channel. The outside rails of the fastener matingly engage the notches with the center rail having the transverse slot for engaging and encompassing the channel tabs thereby locking the fastener to the channel. The present invention provides for an alternative design wherein a channel has a notch forming an alignment for the end clip fastener with the center rail of the fastener mating to the notch wherein the outside rails of the fastener have transverse slots for engaging the opposing flanges of the channel.

A primary object of the present invention is to provide an anchor fastener for mating parts to a channel.

Another object of the present invention is to provide a fastener having a base and an outwardly extending post.

Yet another object of the present invention is to provide a fastener having a post that can be of any shape, size and length.

Still yet another object of the present invention is to provide a fastener having a post whereupon other parts having a cavity can be positioned there over.

Another object of the present invention is to provide a fastener having a base with a post outwardly extending therefrom, while on the opposing side there are three spaced apart rails.

Yet another object of the present invention is to provide a fastener have spaced apart rails with the center rail having a transverse slot.

Still yet another object of the present invention is to provide a fastener having a base with an outwardly extending post with three spaced apart rails positioned on the other side with one or more rails having transverse slot(s) for engaging a channel lip.

Additional objects of the present invention will appear as the description proceeds.

The present invention overcomes the shortcomings of the prior art by providing a fastener for mating parts to a channel. The end clip is comprised of molded polymeric material having means for aligning the clip with a channel and means for locking the clip to the channel. The clip is comprised of a base having an upwardly extending post that forms the means for mounting other parts to the fastener. The post can be of any shape, size or length depending on the part to be mated onto the post.

On the opposing side three spaced apart rails are formed to transversely engage the channel with the center rail also having a transverse slot for matingly locking with the channel. To mount the fastener to the channel the outside rails extend across the channel mating with and engaging notches within the channel flange. The center rail has a slot extending across the distal ends of the rail for matingly engaging and encompassing tabs formed by the channel notches.

There is also an additional element wherein a channel has a notch forming an alignment for the end clip fastener with the center rail of the fastener mating to the notch. The outside rails of the fastener have transverse slots for engaging the opposing flanges of the channel. The channel flange and fastener slots increase the structural integrity of the mating members.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
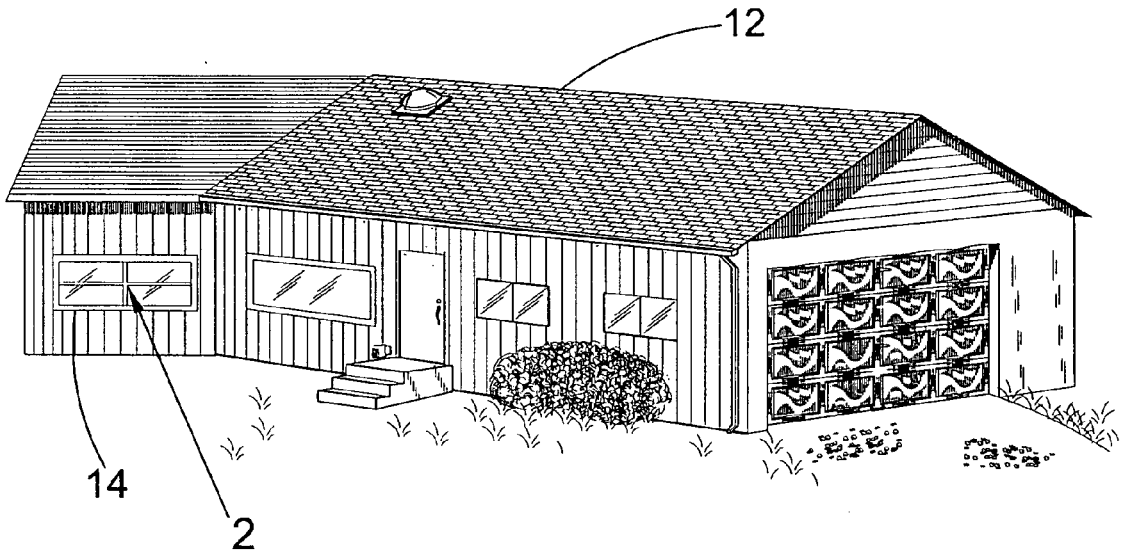
FIG. 1 is an illustrative view of the present invention in use.

With regard to reference numerals used, the following numbering is used throughout the drawings.

10 present invention
12 building
14 window
15 clip
16 base
18 post
20 receiving channel
22 arms
24 extrusion/rail
26 edged extrusion/rail
28 edge
30 channel
32 notches
34 tabs
36 transverse channel/slot
38 flange

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention in use on a building 12. The present invention is a fastener that is used as an anchor for mating various parts with channels. One application of the end clip is the attachment of muntin in a window 14 design. The end clip of the preferred embodiment is comprised of a molded polymeric material having means for aligning the clip with a channel and means for locking the clip to the channel.

Figure 2:
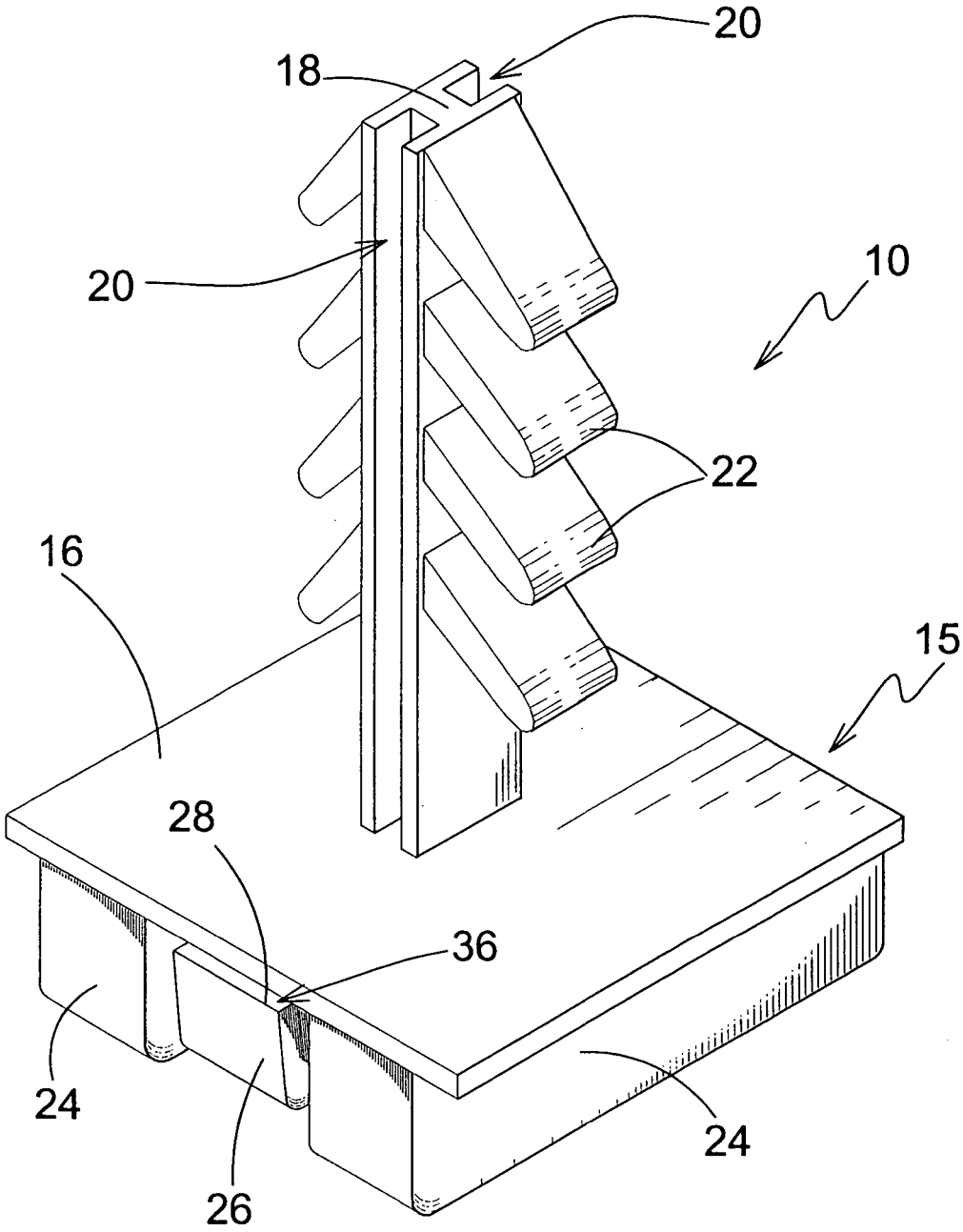
FIG. 2 is a perspective view of the present invention.

Turning to FIG. 2, shown therein is a perspective view of the present invention 10. Shown is an end clip 15 of the present invention 10. The clip 15 is comprised of a base 16 having three rails 24, 26 positioned thereunder providing means for engaging and locking to a channel and a post 18 which may be channeled at 20 extending from the base 16 for the attachment of additional parts. Also shown is a transverse channel 36 within the center rail 26 that provides means for matingly locking with the channel. Wedge arms 22 are also shown. The rails include a pair of outside extrusions 24 and central edged extrusion 26 with edge 28 thereon.

Figure 3:
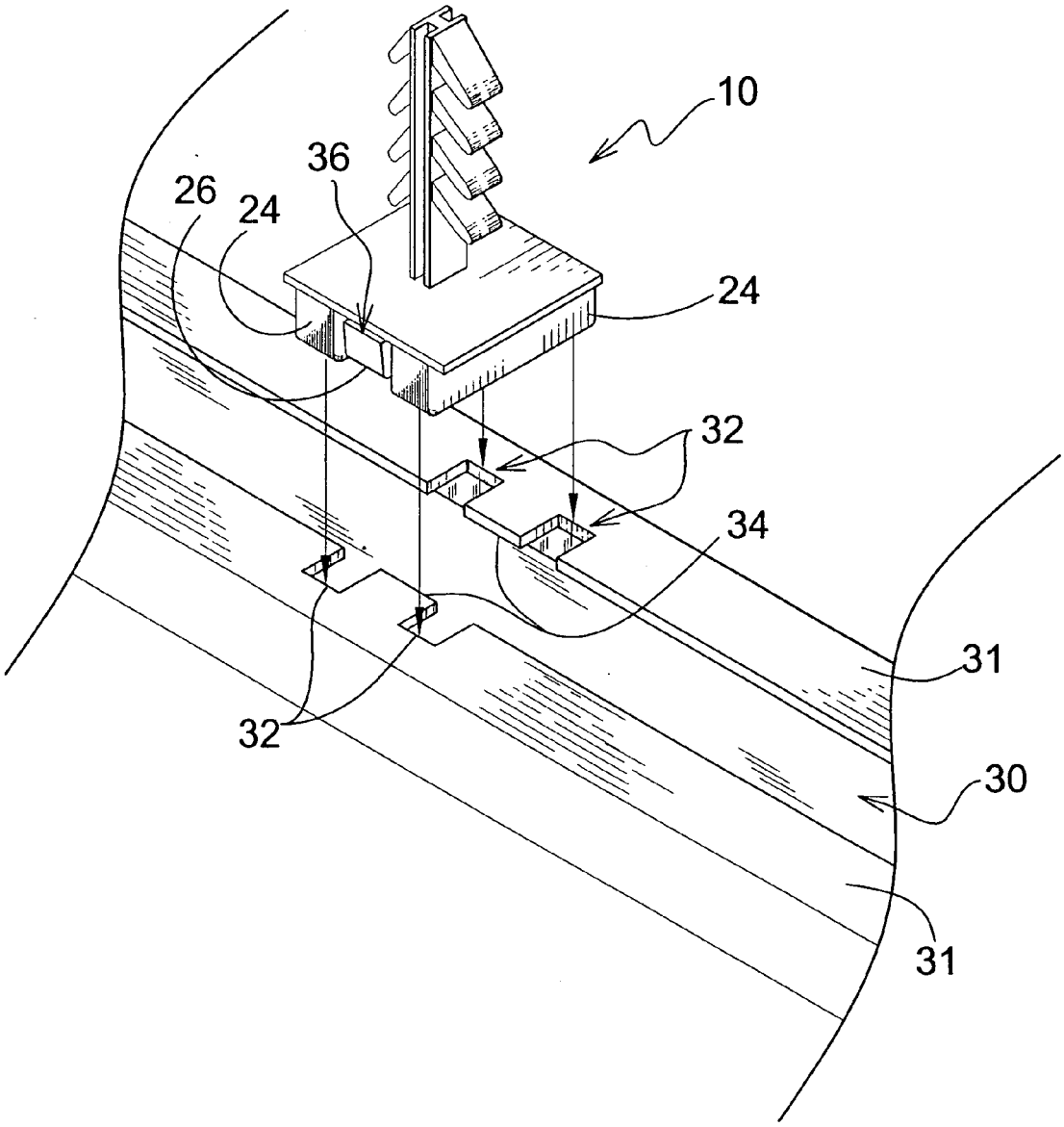
FIG. 3 is a perspective view of a channel.

Turning to FIG. 3, shown therein is a perspective view of a channel 30. Shown is a receiving channel 30 formed between parallel members 31 having spaced apart notches 32 with tabs 34 positioned therebetween on opposing sides of the channel 30. The outside rails 24 of the fastener of the present invention 10 matingly engage the notches 32 with the center rail 26 having a transverse channel 36 for engaging and encompassing the ends of the channel tabs 34 thereby locking the fastener 10 to the channel 30.

Figure 4:
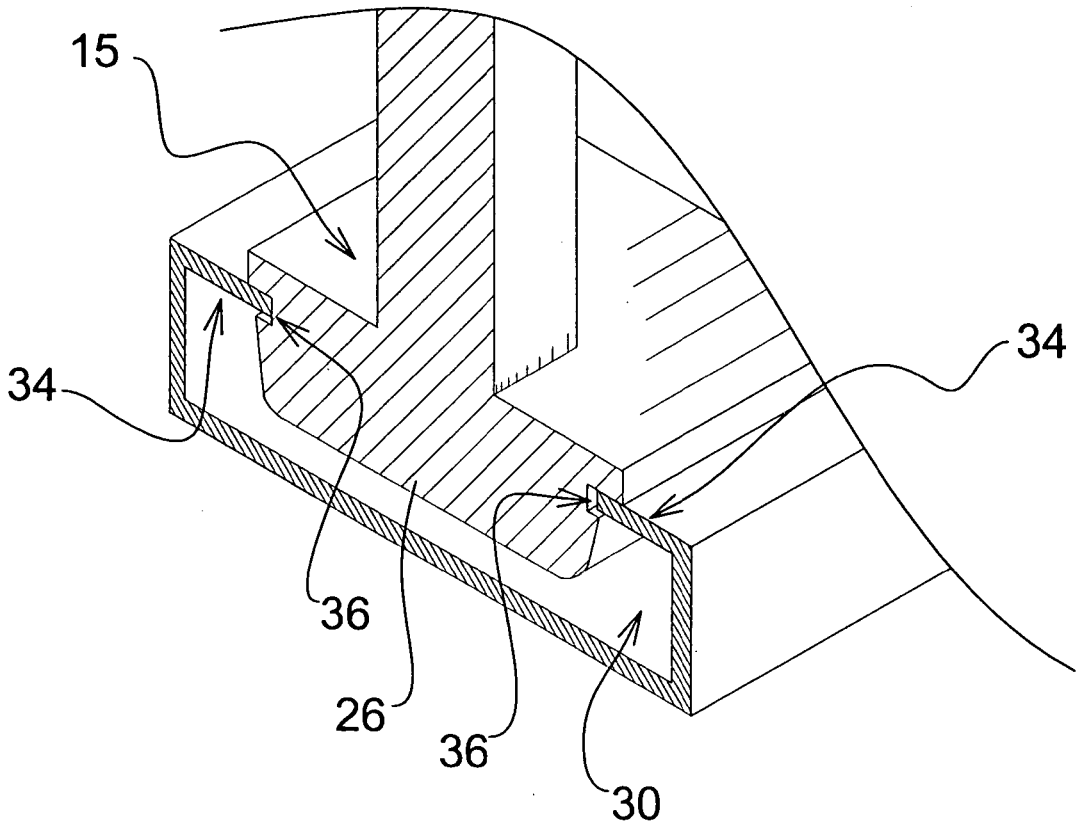
FIG. 4 is a sectional view of the mating end clip and channel.

Turning to FIG. 4, shown therein is a sectional view of the mating end clip 15 and channel. Shown is the center rail 26 of the fastener having a pair of opposite transverse slots 36 with the channel tabs 34 positioned therein. The body of the rail 26 residing within the channel 30 can conform substantially to the cavity of the channel 30 providing a greater degree of protection from torsional forces.

Figure 5:
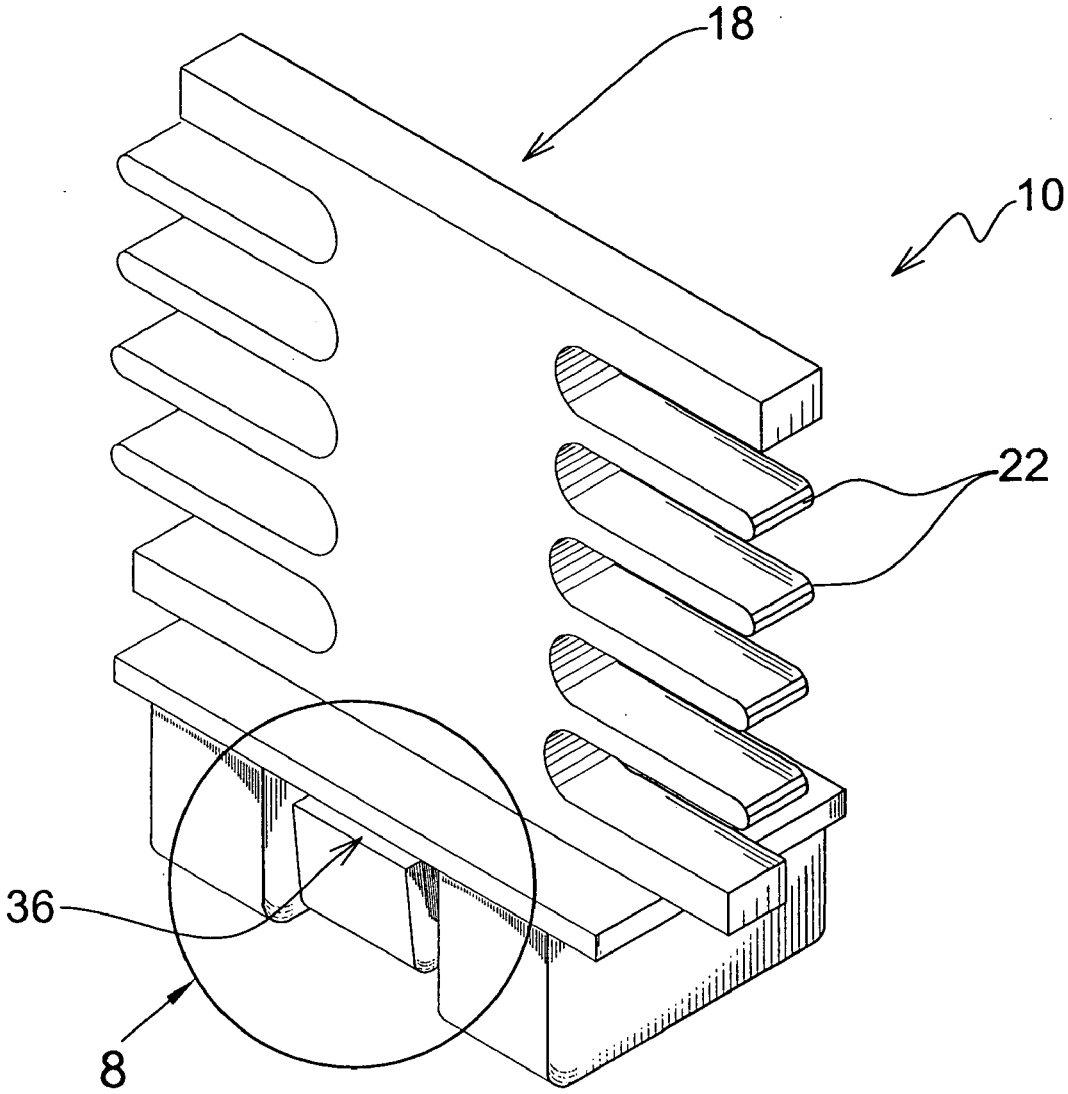
FIG. 5 is a perspective view of a fastener having the present invention.

Turning to FIG. 5, shown therein is a perspective view of a fastener having the present invention 10. Shown is an alternative fastener incorporating the present invention 10 comprising means for engaging notches within a channel and means for locking a transverse slot 36 with a channel tab. The upwardly extending post 18 has multiple arms 22 thereon and forms means for mounting other parts to the fastener 10 that for all intent and purposes forms an anchor whereby the parts can be mounted to a channel transversely.

Figure 6:
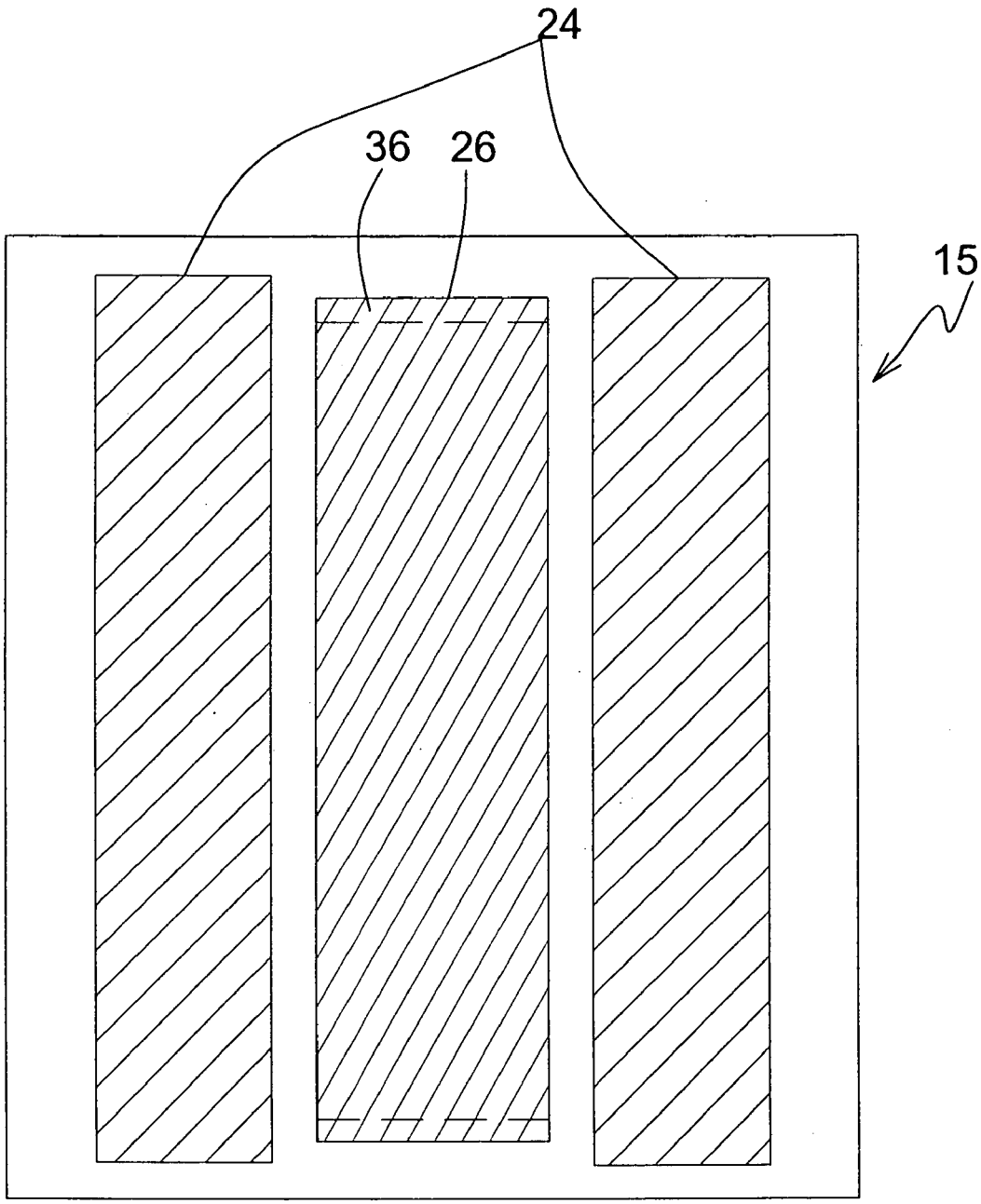
FIG. 6 is a bottom view of the end clip of the present invention.

Turning to FIG. 6, shown therein is a bottom view of the end clip 15 of the present invention. Shown is a bottom view of the present invention comprised of a plurality of spaced apart rails 24, 26. The outside rails 24 extend across the channel mating with and engaging notches within the channel flange. The center rail 26 has a slot 36 extending across the distal ends of the rail for matingly engaging and encompassing tabs formed between the channel notches. The channel tabs and fastener slots 36 increase the structural integrity of the mating members.

Figure 7:
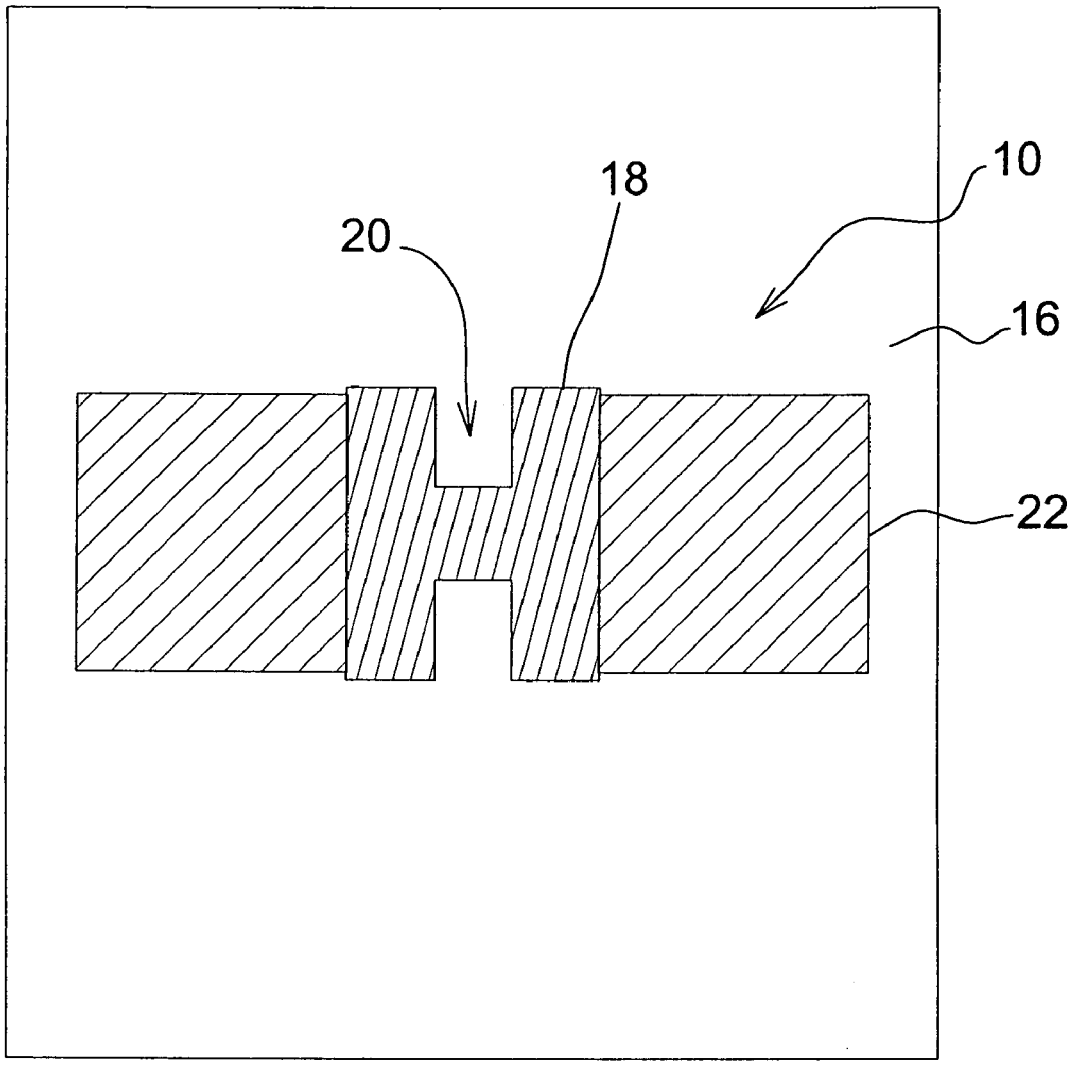
FIG. 7 is a top view of a fastener of the present invention.

Turning to FIG. 7, shown therein is a top view of a fastener of the present invention 10. The fastener of the present invention 10 is comprised of a base 16 having a plurality of spaced apart rails positioned on the underside of the base. On the top side of the base 16 is a post 18 with arms 22 providing means for mounting additional parts having a cavity or channel 20 for receiving the end clip fastener post. The post 18 can be of any shape, size or length depending on the part to be mated to the post. The post 18 forms means for mounting additional parts on the post while the rails, especially the transverse rail slot, forms means for enhancing the mating of the end cap fastener to a channel.

Figure 8:
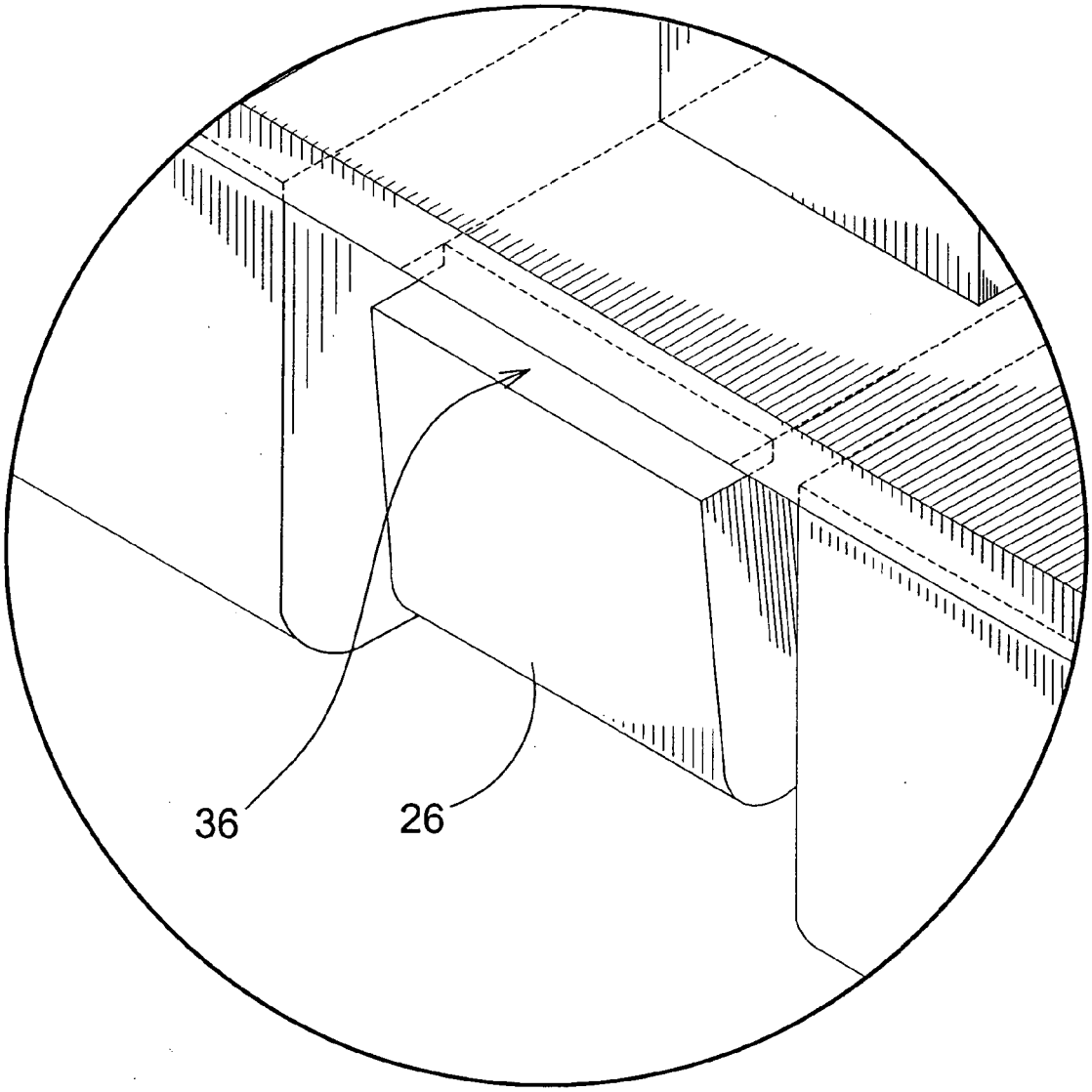
FIG. 8 is an enlarged view of the rail having a transverse slot.

Turning to FIG. 8, shown therein is an enlarged view of the rail 26 having a transverse slot 36. Shown is an enlarged view of the transverse slot 36 positioned on a rail 26 that provides means for locking the end clip fastener to a channel flange. The rail 26 length is determined by the gap or distance between the channel tabs. The rail 26 length has to be sufficient that the channel tabs are seated within the rail slot 36 preventing casual removal of the fastener once mated to the channel.

Figure 9:
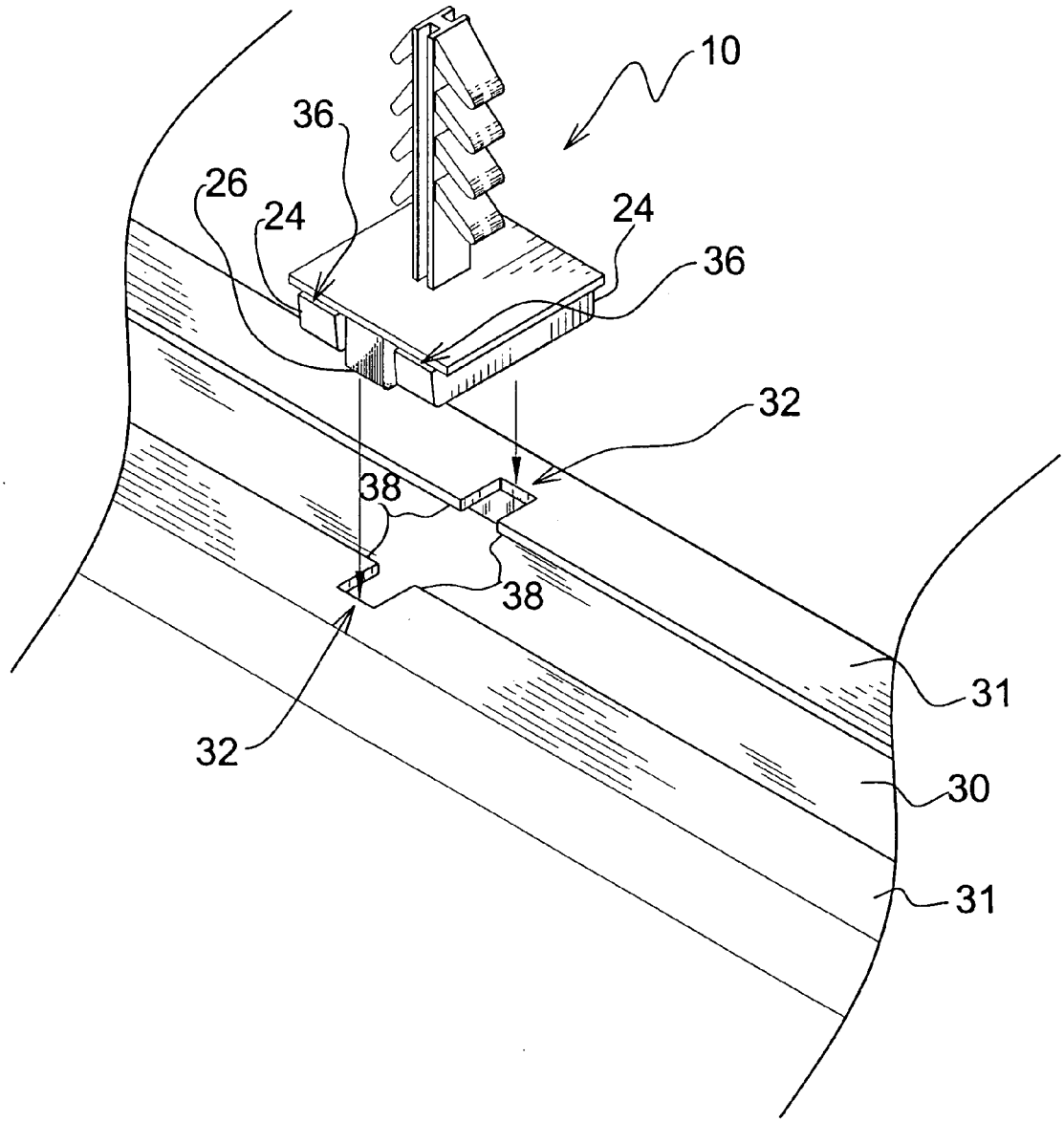
FIG. 9 is a perspective view of an additional element of the present invention.

Turning to FIG. 9, shown therein is a perspective view of an additional element of the present invention 10. Shown is an additional element of the present invention 10 wherein a receiving channel 30 between members 31 has a notch 32 forming an alignment for the end clip fastener of the present invention 10. The center rail 26 of the fastener is mated to the notch 32. The outside rails 24 of the fastener 10 each have transverse slots 36 for engaging the opposing flanges 38 of the channel 30.

Figure 10:
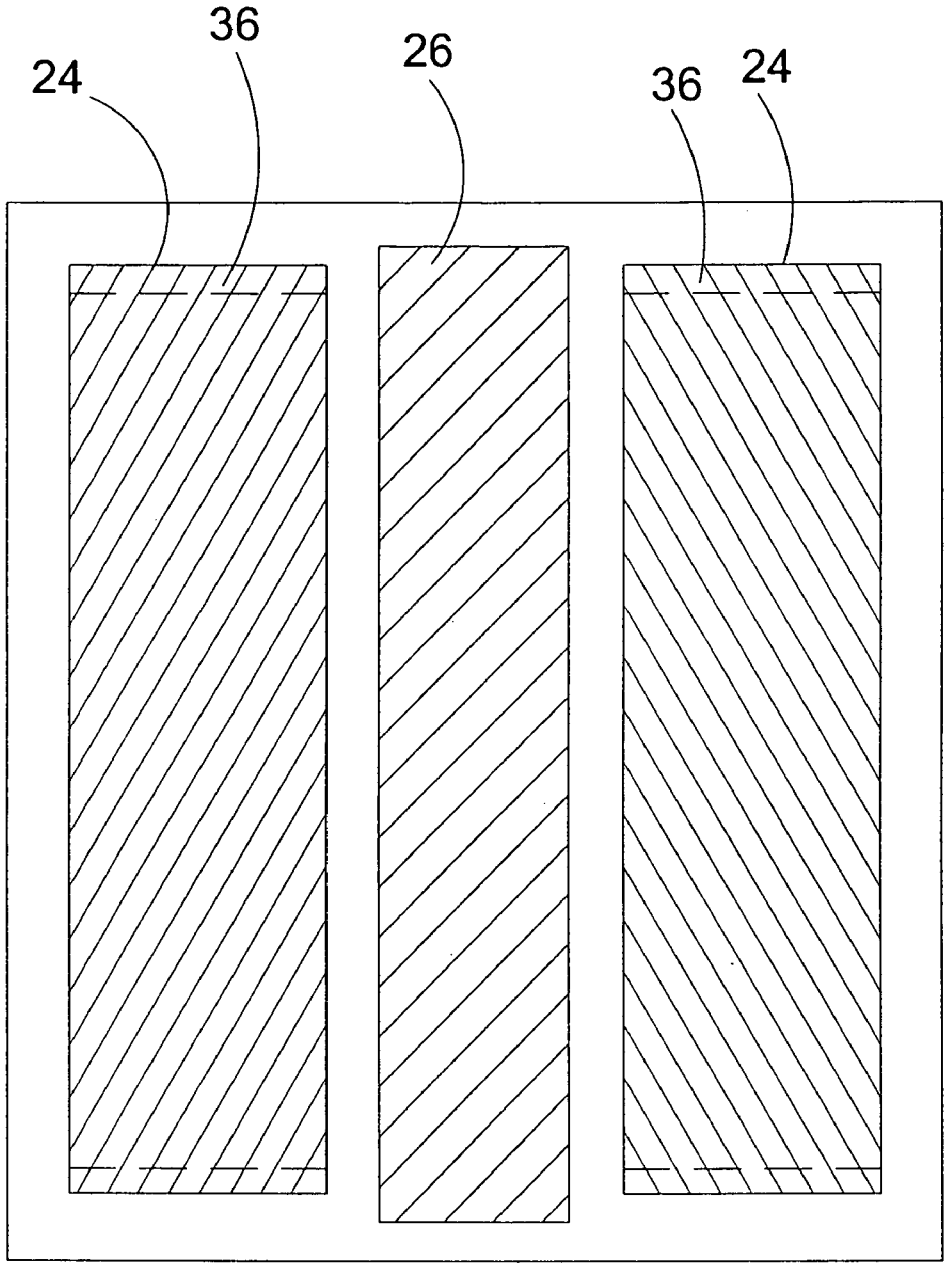
FIG. 10 is a bottom view of the additional element of the end clip of the present invention.

Turning to FIG. 10, shown therein is a bottom view of the additional element of the end clip of the present invention. Shown is a bottom view of the additional element of the present invention comprised of a plurality of spaced apart rails 24, 26. The outside rails 24 extend across the channel having transverse slots 36 on their ends for mating with and engaging the flange of the channel. The center rail 26 extends transversely across the channel and engages opposing notches within the channel proving means for aligning the fastener with the channel. The channel flange and fastener slots 36 increase the structural integrity of the mating members.

I claim:

1. An anchor for mating parts to a channel, the channel formed between a pair of spaced apart parallel frame members, the frame members each having a top surface wherein each top surface has a flange thereon so that a pair of opposing flanges are formed for receiving the anchor therein between, a pair of notches are formed in each of said flanges, wherein said notches are spaced apart so that a tab is formed between said notches, each of said tabs having a tip thereon, said anchor comprising:

a) a clip sized to fit between said channels, said clip having a base thereon, said base having an upper and lower side, a first and second opposing end and a pair of opposing sides thereon so that said first end of said clip attaches to said first flange and said second end of said clip attaches to said second flange;

b) a pair of downwardly extending outside rails disposed on said lower side of said base, said pair of outside rails disposed spaced apart wherein one of said pair of rails is adjacent each said pair of sides of said base, a downwardly extending center rail disposed between said pair of outside rails, said center rail having a first and second opposing end and a top surface, wherein a transverse slot is formed on each of said first and second ends of said center rail, said transverse slot disposed between said top of said center rail and said lower side of said base, wherein one said tip of each said tab is disposed in one of said transverse slots of each said end of said center rail wherein said clip is secured between said pair of channels; and, c) a post disposed on said upper side of said base, said post being generally perpendicular to said base, said post having opposing sides oriented toward said opposing sides of said base and a first and second end oriented toward said first and second opposing ends of said base, wherein a plurality of arms are disposed in a spaced apart relationship along said post, wherein said arms extend laterally away from said post toward said opposing sides of said post so that other objects can be mounted to said post.

2. The anchor of claim 1, wherein each of said notches is about one-half as long as each of the flanges.

3. The anchor of claim 2, wherein said pair of outside rails and said center rail are each substantially perpendicular to the pair of opposing flanges.

4. The anchor of claim 3, wherein said center rail is complementarily shaped as the channel.

5. The anchor of claim 4, wherein the anchor is molded of polymeric material.

6. The anchor of claim 5, wherein said arms number in the range of four to six on each of said sides of said post.

7. The anchor of claim 6, wherein said arms extend from said post generally parallel to the channel.

8. The anchor of claim 7, further comprising a receiving channel disposed on said first and second ends of said post, said receiving channel extending along the length of said post.

9. An anchor for mating parts to a channel, the channel formed between a pair of spaced apart parallel frame members, the frame members each having a top surface wherein each top surface has a flange thereon so that a pair of opposing flanges are formed for receiving the anchor therein between, wherein each of said notches is about one-half as long as each of the flanges, a notch being formed in each of the flanges, said anchor comprising:

a) a clip sized to fit between the channels, said clip having a base thereon, said base having an upper and lower side, a first and second opposing end and a pair of opposing sides thereon so that said first end of said clip attaches to the first flange and said second end of said clip attaches to the second flange;

b) a pair of downwardly extending outside rails disposed on said lower side of said base, said pair of outside rails disposed spaced apart wherein one of said pair of rails is adjacent each of said pair of sides of said base, a downwardly extending center rail disposed between said pair of outside rails, said pair of outside rails each having a first and second opposing end and a top surface, wherein a transverse slot is formed on each of said first and second ends of said outside rail, said transverse slot disposed between said top of said outside rail and said lower side of said base, wherein one end of each of the flanges is disposed in one of said transverse slots of each said end of said outside rail wherein said clip is secured between the pair of channels, said pair of outside rails and said center rail are each substantially perpendicular to the pair of opposing flanges and each of said outside rails is complementarily shaped as the channel; and, c) a post disposed on said upper side of said base, said post being generally perpendicular to said base, said post having opposing sides oriented toward said opposing sides of said base and a first and second end oriented toward said first and second opposing sides of said base, wherein a plurality of arms are disposed in a spaced apart relationship along said post, wherein said arms extend laterally away from said post toward said opposing sides of said post so that other objects can be mounted to said post; and d) a receiving channel disposed on said first and second ends of said post, said receiving channel extending along the length of said post, wherein the anchor is molded of polymeric material, said arms number in the range of four to six on each of said sides of said post and extend from said post generally parallel to the channel.

* * * * *